US005806383A

United States Patent [19]

Hsieh

[11] Patent Number: 5,806,383

[45] Date of Patent: Sep. 15, 1998

[54] CRESCENT WRENCH

[76] Inventor: Chih-Ching Hsieh, No. 64, Lane 107, Liang Tsun Rd., Fong Yuan City, Taichung Hsien, Taiwan

[21] Appl. No.: 746,213

[22] Filed: Nov. 7, 1996

[51] Int. Cl.[6] ..... B25B 13/16

[52] U.S. Cl. ..... 81/170; 81/186; 81/DIG. 5

[58] Field of Search ..... 81/186, 170, DIG. 5, 81/424.5, 119, 121.1; 7/163, 139

[56] References Cited

U.S. PATENT DOCUMENTS

| | | | |
|---|---|---|---|
| 486,764 | 11/1892 | Carpenter | 81/186 |
| 535,480 | 3/1895 | Bennett et al. | 7/139 |
| 1,296,660 | 3/1919 | Hayden | 7/163 X |
| 3,948,120 | 4/1976 | Hancock | 81/170 X |
| 4,563,833 | 1/1986 | Aucoin | 81/424.5 X |
| 4,712,284 | 12/1987 | Coyle, Sr. et al. | 29/240 |
| 5,345,636 | 9/1994 | Lamons | 7/139 |

*Primary Examiner*—D. S. Meislin
*Attorney, Agent, or Firm*—Varndell Legal Group

[57] ABSTRACT

A crescent wrench in which the fixed jaw and the movable jaw have a respective corrugated work face at an inner side facing each other for grasping nuts and bolts, and a respective linear measure mark, for example, inch mark or centimeter mark for linear measurement, the corrugated work face formed into smoothly curved transverse projections and transverse grooves alternatively arranged.

3 Claims, 6 Drawing Sheets

CRESCENT WRENCH

BACKGROUND AND SUMMARY OF THE INVENTION

The present invention relates to crescent wrenches, and more particularly to such a crescent wrench which is practical for grasping and turning normal nuts and bolts as well as worn-out nuts and bolts without causing a damage to the workpiece and, which has graduations for linear measurement.

A variety of crescent wrenches have been disclosed for grasping and turning nuts and bolts, and have appeared on the market. FIG. 1 shows a crescent wrench according to the prior art, which is comprised of a fixed jaw, a movable jaw, and a thumbscrew for turning with the thumb to move the movable jaw relative to the fixed jaw. Because the work faces of the fixed jaw and the movable jaw are plain surfaces, the fixed jaw and the movable jaw can not be positively clamped on a worn-out nut or bolt. Therefore, this structure of crescent wrench is not practical for grasping and turning worn-out nuts, bolts, etc.

FIGS. 2 and 4 and FIGS. 3 and 5 show another two different crescent wrenches according to the prior art. The fixed jaws and movable jaws of these crescent wrenches have a respective serrated work face for positively grasping and turning normal as well as worn-out nuts, bolts, etc. However, the angles of the workpiece tend to be damaged by the triangular teeth (see FIG. 4) or trapezoidal teeth (see FIG. 5) of the serrated work face.

The Present invention has been accomplished to provide a crescent wrench which eliminates the aforesaid drawbacks. It is one object of the present invention to provide a crescent wrench which is practial for grasping and turning normal nuts, bolts, etc., as well as worn-out nuts, bolts, etc. It is another object of the present invention to provide a crescent wrench which does not damage the angle of the workpiece when turning. According to one aspect of the present invention, the fixed jaw and movable jaw of the crescent wrench has a respectively smoothly curved corrugated work face acting against each other for grasping and turning nuts, bolts, etc. According to another aspect of the present invention, the fixed jaw and movable jaw of the crescent wrench are respectively marked with a linear measure mark for example inch mark or centimeter mark for linear measurement.

DETAILED DESCRIPTION OF THE PREFERRED EMBODIMENT

Figure 1:
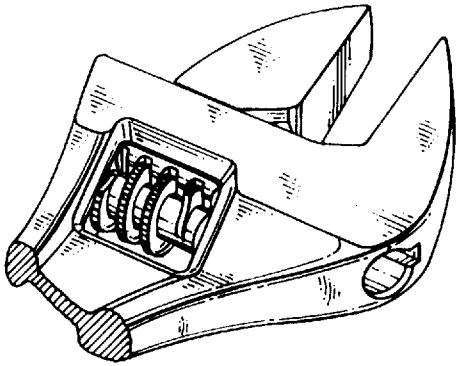
Fig. 1 PRIOR ART
FIG. 1 shows the structure of a crescent wrench according to the prior art.
Figure 3:
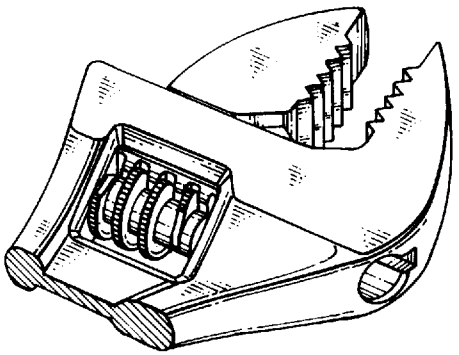
Fig. 3 PRIOR ART
FIG. 3 shows the structure of still another crescent wrench according to the prior art.
Figure 2:
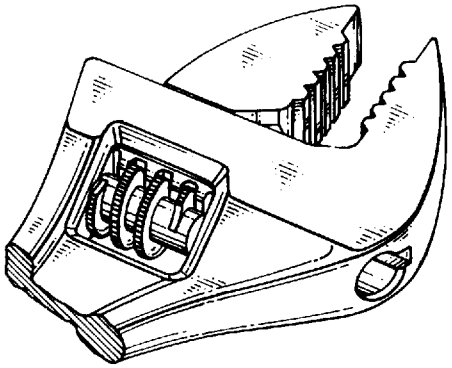
Fig. 2 PRIOR ART
FIG. 2 shows the structure of another crescent wrench according to the prior art.
Figure 5:
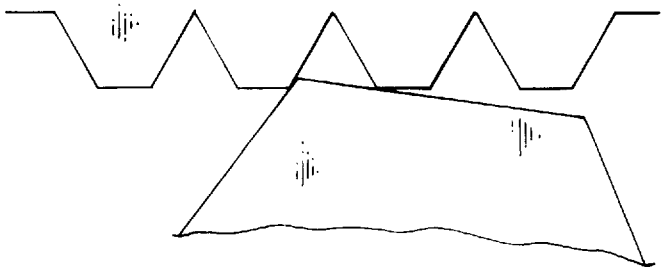
Fig. 5 PRIOR ART
FIG. 5 shows the serrated work face of the crescent wrench of FIG. 3 engaged with one angle of the workpiece.
Figure 4:
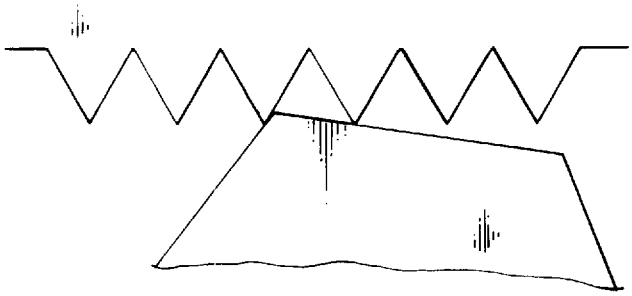
Fig. 4 PRIOR ART
FIG. 4 shows the serrated work face of the crescent wrench of FIG. 2 engaged with one angle of the workpiece.
Figure 6:
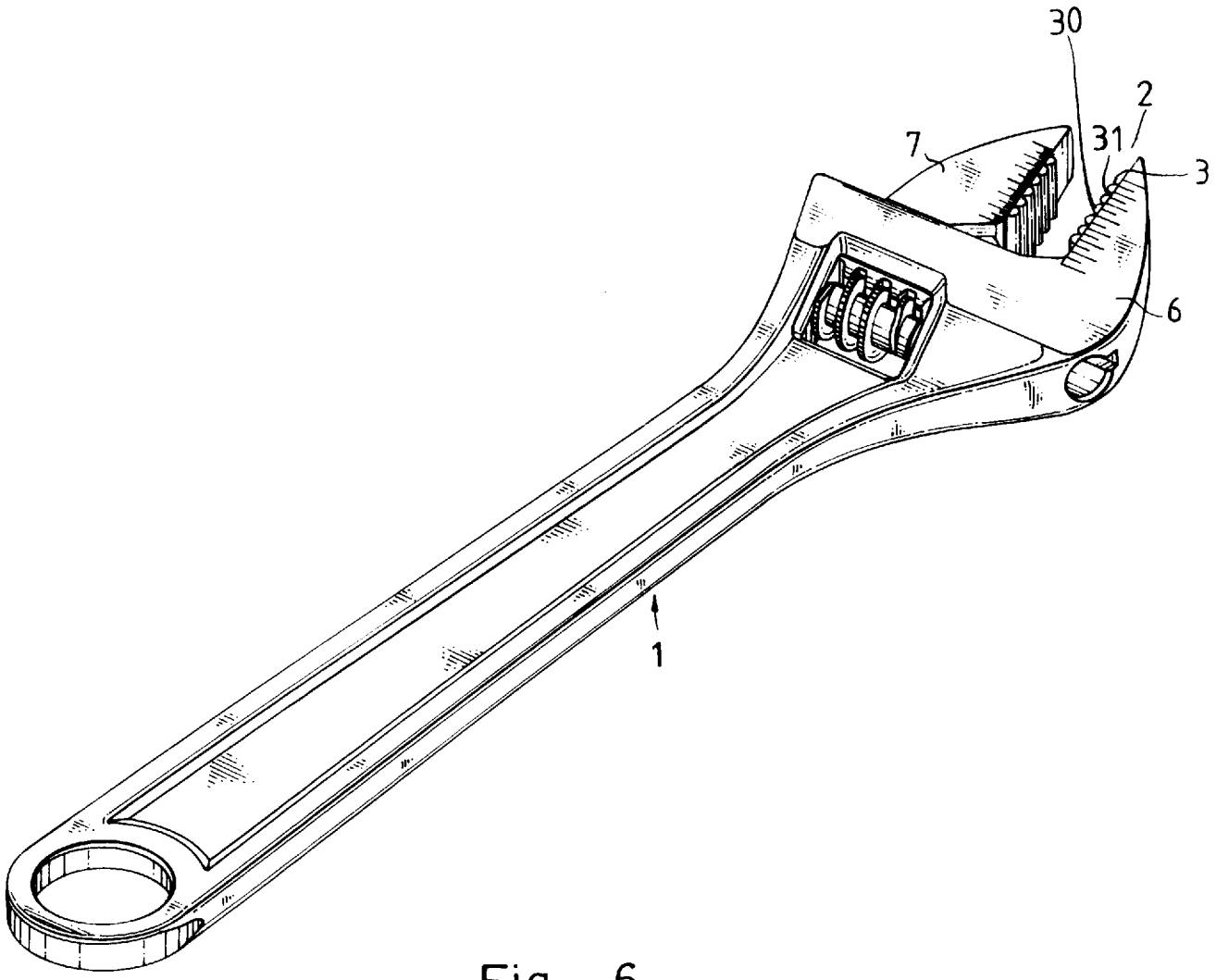
FIG. 6 is an elevational view of a crescent wrench according to the present invention.

Referring to FIG. 6, a crescent wrench 1 in accordance with the present invention is generally comprised of a fixed jaw 6, a movable jaw 7 moved relative to the fixed jaw 6 by hand through a thumbscrew. The fixed jaw 6 and the movable jaw 7 have a respective corrugated work face 3 facing the mouth 2 between the fixed jaw 6 and the movable jaw 7. The corrugated work face 3 is comprised of a plurality of smoothly curved transverse projections 30 and transverse grooves 31 alternatively arranged.

Figure 7:
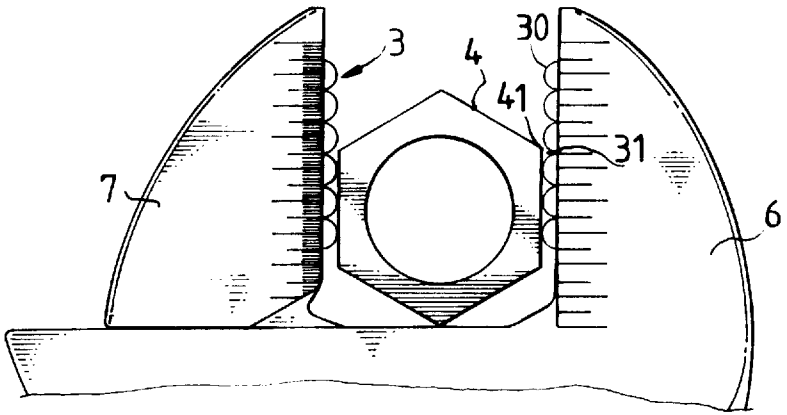
FIG. 7 is an applied view of the present invention, showing the serrated work faces of the fixed jaw and movable jaw clamped on a normal hexagonal head bolt at two opposite sides.
Figure 8:
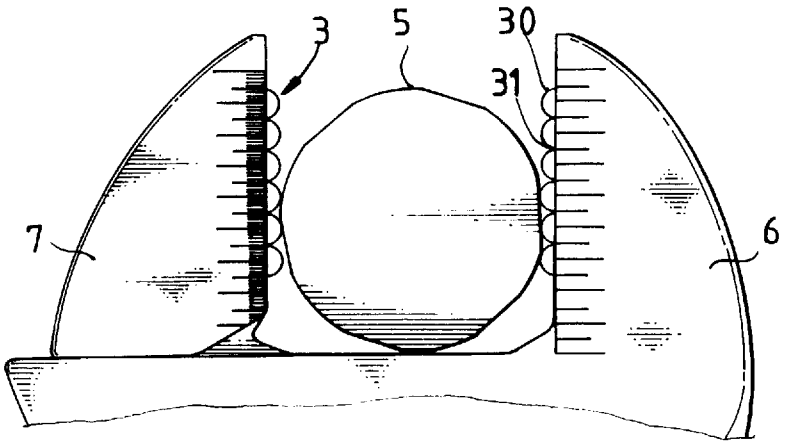
FIG. 8 is another applied view of the present invention, showing the serrated work faces of the fixed jaw and movable jaw clamped on a worn-out hexagonal head bolt at two opposite sides.

As shown in FIGS. 6 to 8, the corrugated work faces each have a plurality of abutting projections 30, and each of the abutting projections 30 has a shape of a cylinder cut by a plane along an axis thereof with a curved surface projecting into the mouth 2 and a flat surface respectively abutting the fixed jaw 6 and the movable jaw 7. The abutting projections 30 extend across the fixed jaw 6 and the movable jaw 7 transversely to the two sides thereof. Any two abutting projections 30 form a groove 31 therebetween extending across the fixed jaw 6 and the movable jaw 7 transversely to the two sides thereof.

Referring to FIG. 7 when the crescent wrench is attached to a workpiece for example of a hexagonal head bolt 4, the corrugated work faces 3 of the fixed jaw 6 and movable jaw 7 are respectively clamped on two opposite sides of the hexagonal head bolt 4, and the angles 41 of the hexagonal head bolt 4 are suspended in grooves 31 in the corrugated work faces 3 of the fixed jaw 6 and movable jaw 7 or disposed far away from the corrugated work faces 3. Therefore, the angles 41 of the hexagonal head bolt 4 will not be damaged when the hexagonal head bolt 4 is turned.

Referring to FIG. 8, the crescent wrench is attached to a worn-out hexagonal head bolt 5, the corrugated work faces 3 of the fixed jaw 6 and movable jaw 7 are respectively clamped on the worn-out periphery of the hexagonal head bolt 5 at two opposite sides, therefore the worn-out hexagonal head bolt 5 can still be firmly grasped and turned.

Referring to FIGS. 6, 7, and 8 again, the fixed jaw 6 and the movable jaw 7 are respectively marked with inch mark and centimeter mark for measuring the size of the workpiece.

I claim:

1. A crescent wrench comprising a fixed jaw, a movable jaw, and a thumbscrew adapted to be turned by a thumb for moving said movable jaw relative to said fixed jaw, said fixed and said movable jaw each having two sides with a corrugated work face arranged between said two sides, said sides of said fixed and movable jaws including linear measuring scale, said corrugated work faces facing each other and forming a mouth for grasping nuts and bolts therebetween, said corrugated work faces each having a plurality of abutting projections, each said abutting projection having a shape of a cylinder cut by a plane along an axis thereof with a curved surface projecting into said mouth and a flat surface respectively abutting said fixed and movable jaws, said abutting projections extending across said fixed and movable jaws transversely to said two sides thereof, and any two said abutting said projections forming a groove therebetween extending across said fixed and movable jaws transversely to said two sides thereof.

2. The crescent wrench of claim 1, wherein said linear measuring scale is an inch mark.

3. The crescent wrench of claim 1, wherein said linear measuring scale is a centimeter mark.

* * * * *